US007445115B2

(12) United States Patent
Tan

(10) Patent No.: US 7,445,115 B2
(45) Date of Patent: Nov. 4, 2008

(54) GOLF BAG BASE

(76) Inventor: Fu-Hsing Tan, ZaoEy Industrial District, Wentang town, Dongcheng, Dong guan (CN) 511700

( * ) Notice: Subject to any disclaimer, the term of this patent is extended or adjusted under 35 U.S.C. 154(b) by 743 days.

(21) Appl. No.: 11/005,087

(22) Filed: Dec. 6, 2004

(65) Prior Publication Data

US 2006/0118442 A1 Jun. 8, 2006

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 5,901,845 A * 5/1999 Cheng ..... 206/315.7
6,264,028 B1 * 7/2001 Wu ..... 206/315.3
6,325,208 B1 * 12/2001 Cheng ..... 206/315.7
6,390,295 B2 * 5/2002 Rhee ..... 206/315.7
6,581,767 B2 * 6/2003 Cheng ..... 206/315.7
2006/0006082 A1 * 1/2006 Fair et al. ..... 206/315.7

* cited by examiner

*Primary Examiner*—Tri M Mai

(57) ABSTRACT

A golf bag base includes a base body, which has a bottom consisting of a sloping surface and a planar surface; a base case to enclose the base body, which comprising a side frame; a sliding shaft provided at a joint position between the sloping surface and the planar surface of the bottom of the base body; and two sliding grooves provided in two symmetrical positions of the side frame of the base case, and two ends of the sliding shaft are protruded from two sliding grooves, respectively. Thus, a largest possible contact area between the golf bag base and the ground can be achieved so as to ensure a stable placement of the golf bag. In addition, a more aesthetical and pleasing appearance can also be attained.

1 Claim, 3 Drawing Sheets

GOLF BAG BASE

FIELD OF THE INVENTION

The present invention is related to golf bag bases and also golf bag with such golf bag base.

BACKGROUND OF THE INVENTION

At present, a portable golf bag of the prior art generally comprises a bag body, a support bracket and a golf base on the bottom of the bag body. When the support bracket is unfolded, the bag body will be tilted and thus a dip angle is formed between the bag body with the ground so that the golf clubs are convenient to be taken out or put in. However, when the golf bag is positioned slantways, the contact area between the golf bag base with the ground becomes smaller comparing with the golf bag is positioned vertically. So, the golf bag is not stably positioned and has not an esthetical appearance.

To solve the above problems, a golf bag base having a planar portion and a slant portion are disclosed that only the planar portion will contact with the ground when the golf bag are positioned vertically, while the slant portion will also partially contact with the ground when the golf bag are positioned slantways. Obviously, the contact area of the golf bag base with the ground becomes larger than before and accordingly the golf bag has a better stability. But, it still does not solve the above-mentioned problems thoroughly and also has a problem of stability and appearance.

Hence it is desired to provide a golf bag base which can overcome the foregoing drawbacks of the prior art.

SUMMARY OF THE INVENTION

A main object of the present invention is to provide a golf bag base which has a good stability and good appearance.

To achieve the above-mentioned object, a golf bag base comprises a base body, which has a bottom consisting of a sloping surface and a planar surface; a base case to enclose the base body, which comprising a side frame; a sliding shaft provided at a joint position between the sloping surface and the planar surface of the bottom of the base body; and two sliding grooves provided in two symmetrical positions of the side frame of the base case, and two ends of the sliding shaft are protruded from two sliding grooves, respectively. As an embodiment, the base case comprises a bottom consisting of a plurality of base feet, which underlie the side frame of the base case and are integrally formed with the side frame of the base case. The sliding groove has a same slope as that of the sloping surface of the bottom of the base body. The sliding grooves are arranged in inner wall of the side frame of the base case. The sliding grooves are arranged in the side frame of the base case corresponding to the sliding shaft, at least one of which are through holes.

A golf bag of the present invention comprises a bag body; a support bracket; a pair of steel wires; and a golf bag base; which comprising a base body, which has a bottom consisting of a sloping surface and a planar surface; a base case to enclose the base body, which comprising a side frame; a sliding shaft provided at a joint position between the sloping surface and the planar surface of the bottom of the base body; and two sliding grooves provided in two symmetrical positions of the side frame of the base case, and two ends of the sliding shaft are protruded from two sliding grooves, respectively.

Comparing with the prior art, the base case of the golf bag base is always in full contact with the ground whenever the golf bag is in an upright orientation or in a slanted orientation. Thus, a largest possible contact area between the golf bag base and the ground can be achieved so as to ensure a stable placement of the golf bag. In addition, the golf bag base cannot be seen to tilt upwardly, so a more aesthetical and pleasing appearance can be attained.

For the purpose of making the invention easier to understand, some particular embodiments thereof will now be described with reference to the appended drawings in which:

DETAILED DESCRIPTION OF THE INVENTION

Figure 1:
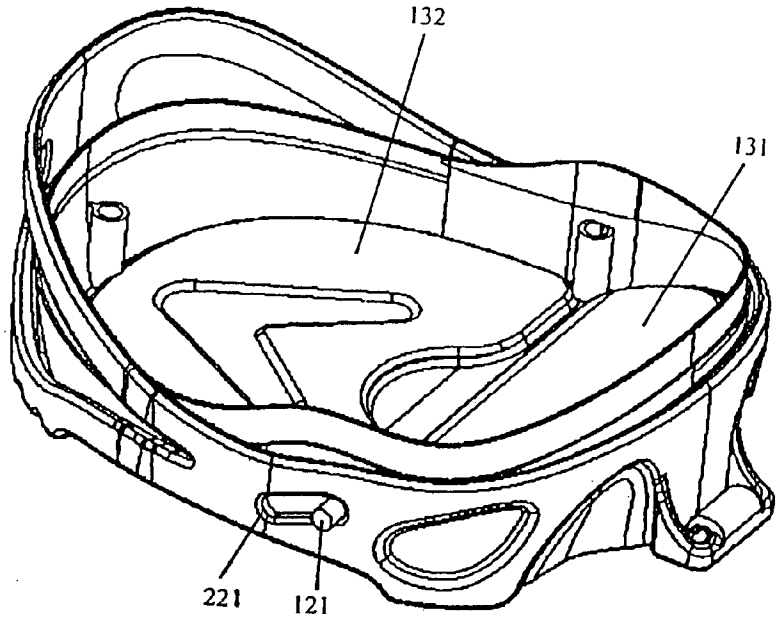
FIG. 1 is a schematic, perspective view of a golf bag base of the present invention when the golf bag being positioned uprightly.

Referring now to the drawings in detail, referring to FIGS. 1-4, according to an embodiment of the present invention, a golf bag comprises a bag body 3, a support bracket, a pair of steel wires; and a golf bag base. The golf bag base includes a base body 1, which has its side frame 12 engaged with the bag body 3, and its bottom 13 tilts upwardly so as to form a sloping surface 131 and a planar surface 132. The base body 1 is enclosed by a base case 2, which is received therein. In the present invention, a sliding shaft 121 is provided at a joint position between the sloping surface 131 and the planar surface 132 of the bottom 13 of the base body 1. Two sliding grooves 221 are provided in two symmetrical positions of the side frame 22 of base case 2, and two ends of the sliding shaft 121 are protruded from two sliding grooves 221, respectively.

Also referring to FIGS. 1-4, each of the sliding grooves 221 can be a bar-shaped groove which has a slope. The sliding grooves 221 can be arranged in the inner wall of the side frame 22 of the base case 2, which may be a blind hole. The sliding shaft 121 can be held by the two sliding grooves 221. In this way, the base body 1 is able to rotate by a certain degree with the sliding shaft 121 as rotation axis. Meanwhile, the base body 1 is able to move relative to the sliding grooves 221 with the sliding shaft 121 as a support means. As an embodiment, each of the sliding grooves 221 can selectively be a through hole, as shown in the appended drawings.

Figure 2:
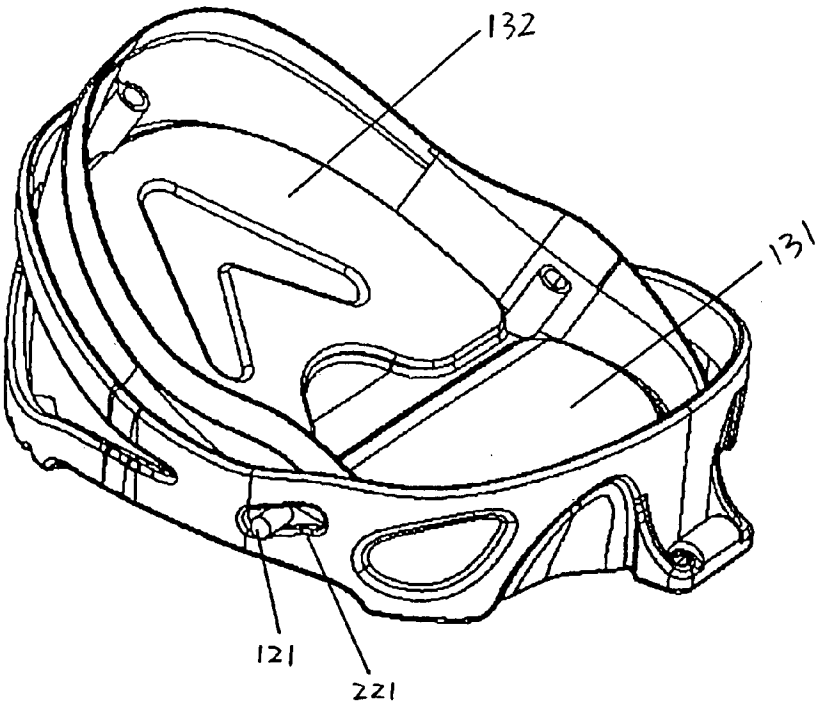
FIG. 2 is a schematic, perspective view of the golf bag base of FIG. 1 when the golf bag being positioned slantways.

In the present invention, it is preferred that the slope of the sliding grooves 221 are the same as the slope of the sloping surface 131 of the bottom 13 of the base body 1 without reference to the golf bag are placed uprightly or slantways. As shown in FIG. 1, when the golf bag is placed uprightly, the sliding shaft 121 rests at top end of the sliding grooves 221. When the golf bag is placed slantways, the sliding shaft 131 rests at bottom end of the sliding grooves 221, as shown in FIG. 2. In the present invention, when the golf bag changes from an upright orientation to a slanted orientation, the base body 1 will rotate by a certain degree as the sliding shaft 121 as rotation axis, while the base body 1 moves downwardly relative to the sliding grooves 221 with the sliding shaft 121 as a support means. During this process, the base case 2 keeps unmoved relative to the ground so that it always fully contact with the ground whenever the golf bag is in an upright orientation or in a slanted orientation. Thus, a largest contact area between the golf bag base and the ground can be achieved so as to ensure a stable placement of the golf bag. In addition, when the golf bag is placed slantways, the golf bag base cannot be seen to tilt upwardly, so a more aesthetical and pleasing appearance can be attained.

Figure 3:
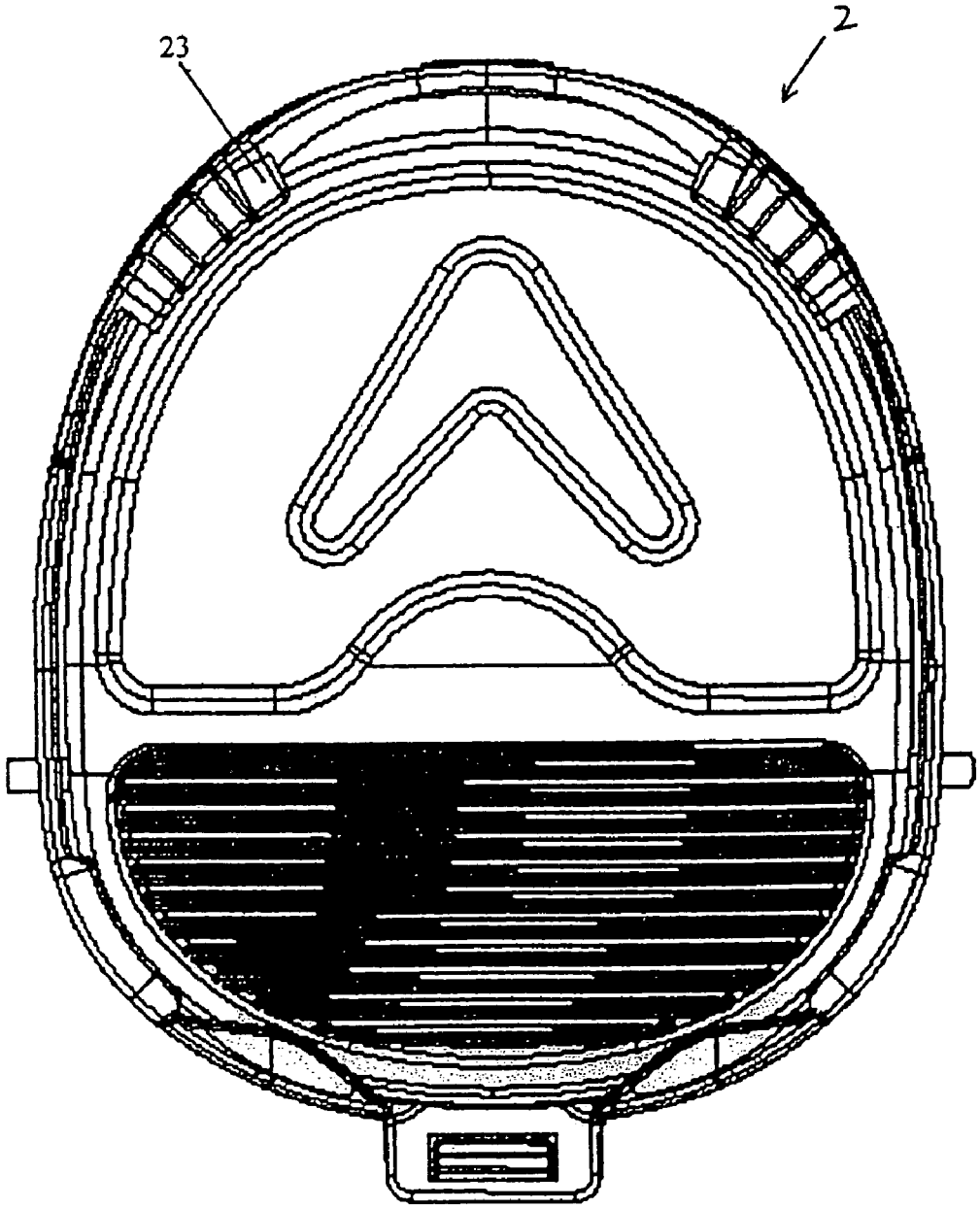
FIG. 3 is a schematic, bottom view of the golf bag base of FIG. 2.
Figure 4:
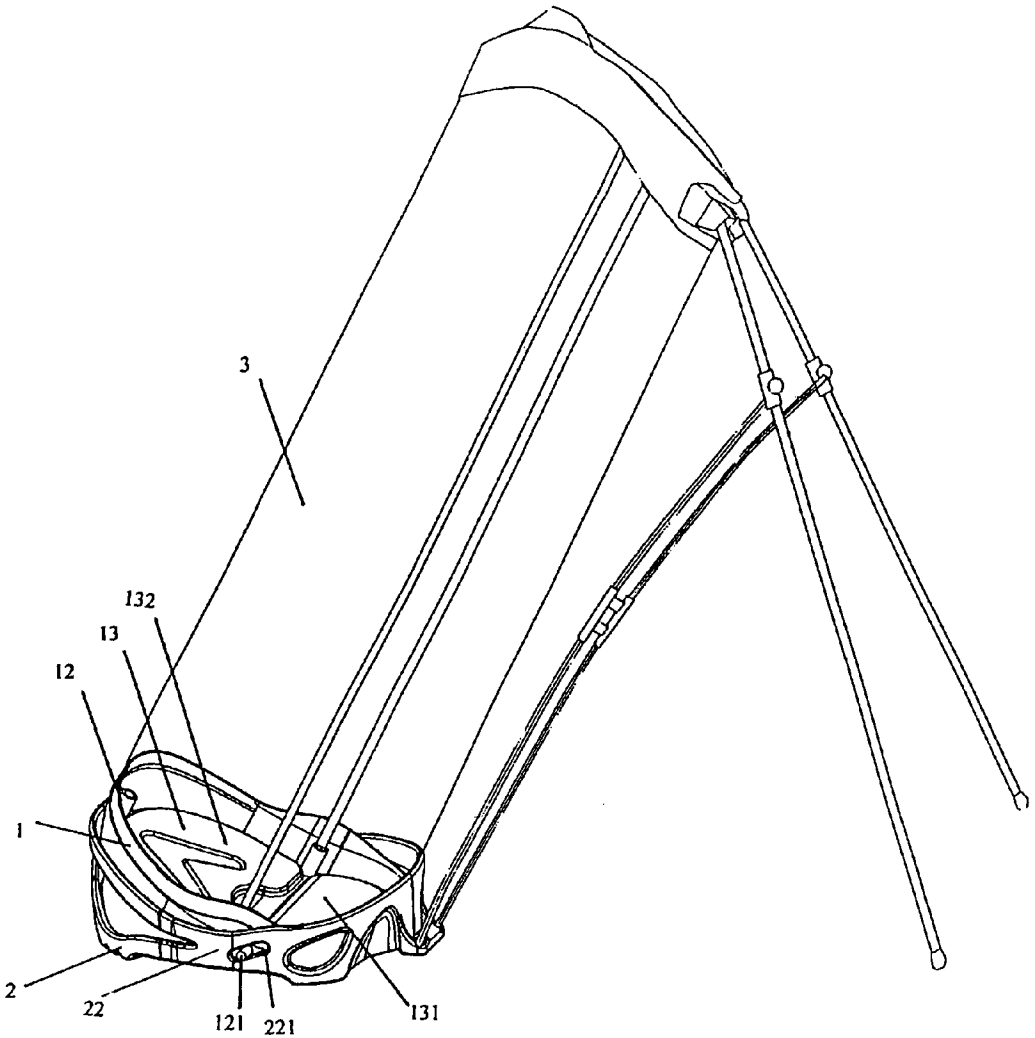
FIG. 4 is a perspective view of the golf bag base being used in a golf bag.

In order to reduce the weight of the golf bag, the bottom of the base case 2 can be a plurality of base feet 23, which underlie the side frame 22 of the base case 2 and are integrally formed with the side frame 22, as shown in FIG. 3. The base feet 23 are a plurality of contact feet which extend from the side frame 22 and are widened. The contact feet are also slip-proof and horizontally placed. When the golf bag are placed uprightly, the base feet 23 meet the bottom 13 of base body 1 directly, which bearing the weight of the bottom 13 of base body 1 and sharing the load force with the sliding shaft 121. In addition, such a configuration lowers the weight of the golf bag base and saves material.

In accordance with the present invention, the base case 2 of the golf bag base is always in full contact with the ground whenever the golf bag is in an upright orientation or in a slanted orientation. Thus, a largest possible contact area between the golf bag base and the ground can be achieved so as to ensure a stable placement of the golf bag. In addition, the golf bag base cannot be seen to tilt upwardly, so a more aesthetical and pleasing appearance can be attained.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A golf bag base comprising;

a base body. which has a bottom consisting of a sloping surface and a planar surface;

a base case to enclose the base body, which comprising a side frame;

a sliding shaft provided at a joint position between the sloping surface and the planar surface of the bottom of the base body; and two sliding grooves provided in two symmetrical positions of the side frame of the base case, and two ends of the sliding shaft are protruded from two sliding grooves, respectively;

wherein the base case comprising a bottom consisting of a plurality of base feet, which underlie the side frame of the base case and are integrally formed with the side frame of the base case; the sliding groove has a same slope as that of the sloping surface of the bottom of the base body; the sliding grooves are arranged in inner wall of the side frame of the base case; and wherein the sliding grooves are arranged in the side frame of the base case corresponding to the sliding shall, at least one of which are through holes.

* * * * *